US005395027A

United States Patent [19]

Erhardt

[11] Patent Number: 5,395,027

[45] Date of Patent: Mar. 7, 1995

[54] PRINTING SYSTEM HAVING OPTICAL SUPERVISION APPARATUS OF A SUBSTRATE RUNNING WEB, PARTICULARY A PAPER WEB

[75] Inventor: Bruno Erhardt, Aindling, Germany

[73] Assignee: Man Roland Druckmaschinen AG, Offenbach am Main, Germany

[21] Appl. No.: 940,030

[22] Filed: Sep. 3, 1992

[30] Foreign Application Priority Data

Sep. 14, 1991 [DE] Germany ..... 41 30 677.5

[51] Int. Cl.[6] ..... B65M 26/02

[52] U.S. Cl. ..... 226/24; 226/45

[58] Field of Search ..... 226/43, 10, 11, 45, 226/20, 24; 73/159; 250/571; 356/434, 435

[56] References Cited

U.S. PATENT DOCUMENTS

| | | | |
|---|---|---|---|
| 3,444,358 | 5/1969 | Malone | 250/571 X |
| 3,690,772 | 9/1972 | Endl | 356/434 X |
| 3,732,016 | 5/1973 | DeShayes et al. | 356/434 |
| 3,974,248 | 8/1976 | Atkinson | 73/159 X |
| 4,004,150 | 1/1977 | Natelson | 356/434 X |
| 4,098,641 | 7/1978 | Casey et al. | 356/434 X |
| 4,186,309 | 1/1980 | Gnuechtel | 250/561 |
| 4,288,272 | 9/1981 | Pfeffer | 250/571 X |
| 4,289,406 | 9/1981 | Maddox | 356/434 X |
| 4,384,337 | 5/1983 | Mamberer et al. | 101/426 X |
| 4,395,127 | 7/1983 | Duvall | 250/561 |
| 4,483,619 | 11/1984 | Léveque et al. | 356/434 |
| 4,824,001 | 4/1989 | Mick, Jr. et al. | 226/20 X |
| 4,833,591 | 5/1989 | Eckl | 364/167.01 |
| 4,865,872 | 9/1989 | Pellatiro | 73/159 X |
| 4,908,762 | 3/1990 | Suzuki et al. | 356/434 X |
| 5,086,220 | 2/1992 | Berthold et al. | 250/571 X |

FOREIGN PATENT DOCUMENTS

| | | |
|---|---|---|
| 031881 | 7/1981 | European Pat. Off. . |
| 0289185 | 11/1988 | European Pat. Off. . |
| 0443062 | 8/1991 | European Pat. Off. . |
| 709526 | 8/1941 | Germany . |
| 1917877 | 11/1969 | Germany . |
| 2156506 | 11/1972 | Germany . |
| 2618387 | 11/1977 | Germany . |
| 2913410 | 10/1980 | Germany . |
| 3222395 | 1/1983 | Germany . |
| 3305606 | 8/1984 | Germany . |
| 60-64851 | 4/1985 | Japan . |
| 3044603 | 2/1991 | Japan . |
| 1307664 | 2/1973 | United Kingdom . |

*Primary Examiner*—Joseph J. Hail, III
*Assistant Examiner*—John P. Darling
*Attorney, Agent, or Firm*—Frishauf, Holtz, Goodman & Woodward

[57] ABSTRACT

To provide a compact monitoring unit for substrate webs passing through a printing machine, typically paper webs, and thereby provide rapid response of damage control units, such as paper capturing rollers, small tears, fissures or holes in the substrate webs are sensed by locating an elongated light source (12) below the web, the light source extending beyond the lateral sides of the web to be supervised; an optical scanner (2) formed of a plurality of light guides (4) within a plastic block (5a) provides signals representative of light shining through damaged areas, and on the side of the web. The light guides then are bundled or compressed in a bundling or compression element (6), and the outputs thereof are applied to a charge coupled device sensor chip (7), directly, without intervention of optical systems, the charge coupled device being in turn connected to an evaluation and control unit which can provide "damaged web" signals to the damage control unit itself through a suitable output coupling.

20 Claims, 3 Drawing Sheets

PRINTING SYSTEM HAVING OPTICAL SUPERVISION APPARATUS OF A SUBSTRATE RUNNING WEB, PARTICULARY A PAPER WEB

Reference to related publications:

German Patent 33 05 606;

German Patent 26 18 387, Laubscher et al, assigned to a predecessor company of the assignee of the present application;

German Patent Publication Document 1,917,877, Akamatsu et al.

1. Field of the Invention

The present invention relates to printing machinery, and more particularly to an apparatus for optical supervision of the running of a substrate web, typically a paper web in the printing machine, to determine if the web runs properly, under proper tension, and does not have tears or fissures which, in due course of the passage of the web through the machine and accessories, might cause machine damage; and more particularly to such an apparatus which provides an early warning signal to control a damage control apparatus, such as as a paper capturing apparatus.

2. Background

Running webs, for example paper webs in a printing machine, require increasingly sophisticated and rapidly operating warning apparatus since the webs pass through the printing machine at increasing speeds. It is necessary to supervise the web not only for total tear-throughs or severing, but also to recognize small tears, for example at the edge, or holes or fissures within the web, particularly such tears, holes or fissures which exceed a predetermined size. These defects must be sensed as soon as possible before they can grow to such an extent that damage to the machine may result. Thus, damage control must be initiated promptly as soon as any defect exceeding a minor or insignificant one—as determined by experience—is found.

Tears in a paper web passing through a rotary printing machine can lead to severe damage of the printing system since the web may have the tendency to wrap itself around a cylinder, if the machine cannot be stopped rapidly. Rapid stopping, however, is frequently impossible due to the inertia of the printing machine cylinders, so that early recognition of even small defects, which may lead to more substantial damage to the web, is desirable. If the web winds itself about a cylinder, it is necessary not only to stop the machine which leads to substantial interruption in machine printing, but may also result in substantial costs to repair damage, and to then re-adjust the machine.

Various types of sensors to supervise running webs have been proposed, for example sensors which are responsive to reflected light, ultrasonic sensors and even video camera monitoring systems.

Video camera systems have problems since flutter in the web, resulting in changes in the level of the web with respect to the sensing apparatus, may signalize changes in the lateral alignment or width of the web. A side tear may cause the web to deflect laterally, so that the camera must be responsive to lateral dimensions. To avoid false alarms, it is necessary to mount the video camera with respect to the paper web such that it has a large distance therefrom. This large space requirement inhibits locating the system close to a printing system, and recognition of a defect close to the point where it starts, so that early recognition cannot be obtained thereby. Delay times, thus, will result so that even the most efficient damage control system, such as a web capturing system, cannot respond fast enough; likewise, a stop-motion system to stop the machine cannot respond quickly enough.

The referenced German Patent 33 05 606 describes a photo-electric monitoring system which has a reflected light sensor, so that tears on the paper can be determined. Electrical signals from the photo-electric sensors are evaluated by an evaluation apparatus which provides output signals, such as "torn web" or similar damage signals which, in turn, then can be used to control a stop-motion device for the machine as well as initiate paper capturing or other damage control. Reflected light sensors have the advantage that flutter or movement of the web transverse to its extent can be recognized. Unfortunately, however, reflected light sensors cannot be constructed with the necessary resolution. Thus, small tears, for example tears of less than 10 mm in extent, cannot be recognized thereby. Ultrasound sensors, likewise, cannot recognize small tears. It is desirable, however, to recognize even small tears since they have a tendency to rapidly expand as the web is pulled through the printing machine system, so that total severing or tear-through of the web, eventually, can be recognized before it occurs. If the width of the web changes, it is difficult to adjust the prior art apparatus to webs of different widths.

THE INVENTION

It is an object to provide a photo-electric sensing apparatus for use in combination with a printing machine which is compact in the region of the monitoring or supervising area, can be located in tightest space, and has sufficient resolution in order to recognize defects, such as tears, holes and the like in the web which are smaller than 10 mm, so that defects can be recognized early and counteracting measures can be taken to prevent damage to the printing machine.

Briefly, an elongated light source is placed transversely of the longitudinal extent of the web, that is, across the web and one side thereof, for example at the bottom side. The light source is wider than the largest width of the web to be supervised. The web is then scanned by an optical scanner which is formed by a plurality of fiber-optic light guides positioned at the other side of the web, so that the web passes between the light source and the ends of the light guides. The ends of the light guides are placed, preferably in a plastic block, spaced from the web by distances which provide for linear resolution of between about 1 to 5 mm, or even less. The light guides are then directly coupled to a bundling or compression element, where they are closely bundled together and the light guides are then exposed to a charge coupled device (CCD), in form of a CCD sensor chip which recognizes the light transmitted from each one of the now bundled or compressed light guides. The bundling or compression element associates each of the light guides with a specific pixel of the CCD sensor chip. The CCD is coupled to a signal evaluation and control unit which, in turn, provides a warning output signal to a damage control apparatus, such as a paper capturing unit or the like. CCDs are well known commercial elements used, for example, in video cameras. They are semiconductor devices arrayed so that the electric charge at the output of one provides the input stimulus to the next, from which output signals can be obtained.

The optical scanner thus, in effect, is a linear line scanner, which also is wider than the widest width of the web to be supervised. Locating the light source at the opposite side of the web with respect to the glass fiber optics, in which both the light source as well as the glass fiber-optics are wider than the widest web to be supervised provides for projection of the web on the linear glass fiber optics line scanner while ensuring that, for a normal-size web, some of the light guides will always be fully illuminated; the CCD chip can readily evaluate the thus conducted light signals, by evaluating the light from the light guides in the form of pixels.

DRAWINGS

DETAILED DESCRIPTION

Figure 1:
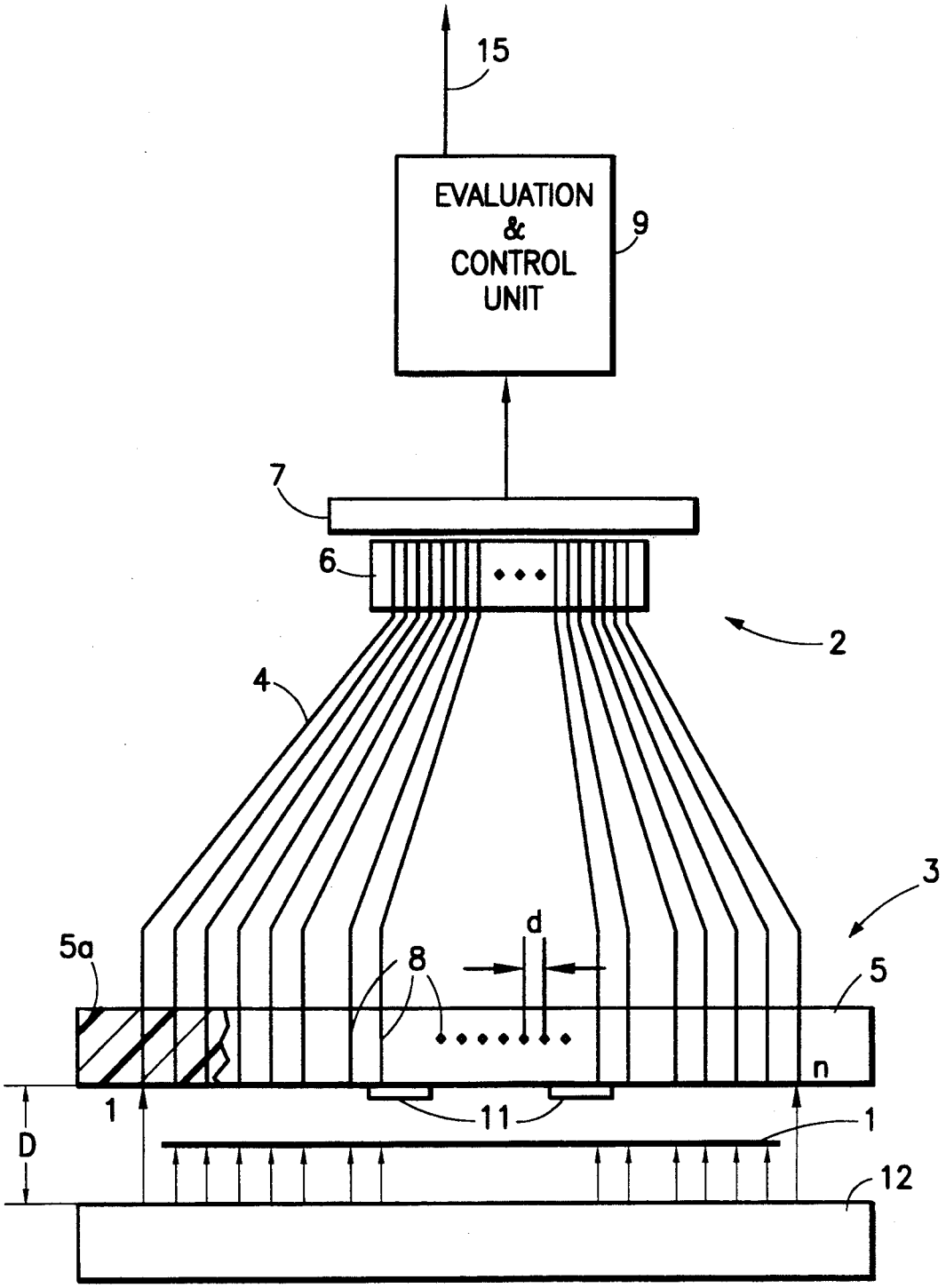
FIG. 1 is a highly schematic vertical view of the monitoring apparatus in accordance with the present invention.

A paper web 1 (FIG. 1) running through a printing machine printing station 18 (FIG. 3) is scanned by an optical scanner 2, having glass fiber optics 3. The glass fiber optics 3 is formed of individual light guides 4. There are more light guides 4 than the width of the web 1 requires, that is, the scanner 2 scans across a wider region than the paper web 1. The end guide or guides, of which only one is shown in FIG. 1, thus are exposed directly to light from a light source 12 located beneath the web 1. The light guides 4 are bundled together in a light guide bundling or compression element 6 so that they can be directly applied to image a CCD sensor chip 7. The sensor chip 7 can be integrated in the entire scanning system 2.

Preferably, the light guides 4 are embedded in a plastic block 5*a* which is polished at the side facing the paper web 1. This substantially facilitates cleaning the linear line scanner 5.

The light guide bundling or compression element 6 has the function to change the various positions 8 of the light guides 4 to a cross section or line or area which corresponds to the line or area of the surface of the CCD sensor chip 7. The CCD sensor chip 7 can be a line element or an a real element, and the bundling or compression element 6 converts the linear light guide array to one which fits the sensing surface of the chip 7.

The number n of light guides is determined by the width of the web to be scanned. Typically, the space d between two adjacent positions 8 of the light guide, to which the web 1 is exposed, can vary between 1 to 5 mm.

Figure 3:
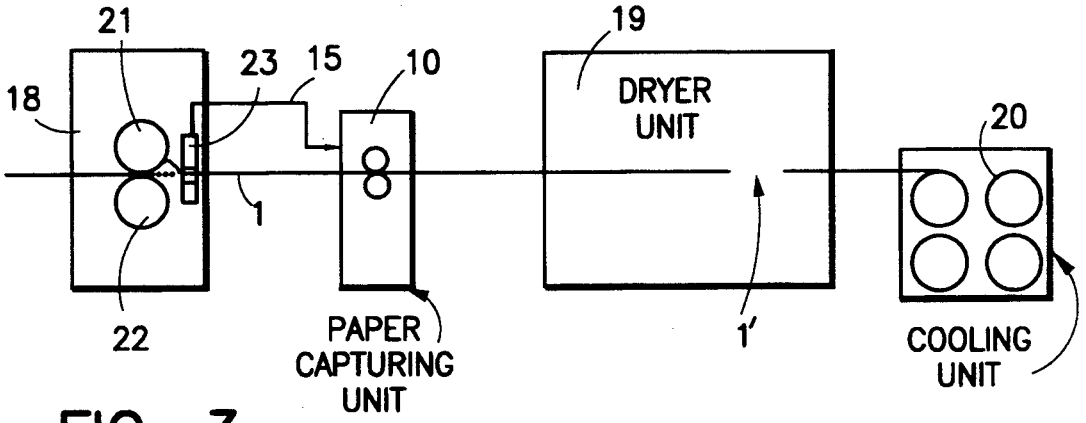
FIG. 3 is a schematic representation of the supervisory system for a printing machine.

The CCD sensor chip 7 is coupled, in known manner, to an evaluation and control unit 9 which provides an output signal, if a defect such as a tear or hole is sensed, to a control connection 15 which, in turn, controls a damage control unit 10 (FIG. 3).

In accordance with a preferred feature of the invention, and to provide yet another level of supervisory control, one or more reflected light sensors 11 are located in the scanning system 2, for example laterally adjacent the optical line sensor 5 (see FIG. 2A) to sense flutter, that is, the movement of the paper web 1 between the light source 12 and the linear sensor 5. The reflected light sensor 11 can be integrated in the scanning system 2, and coupled to the evaluation and control unit 9, so that, as an additional information source, substantial deviation in height of the paper web, that is, the level of the paper web between the sensor 5 and the light source, can be reliably recognized. This provides a sure recognition of loss of tension in the paper web, for example due to a complete tear-through arising downstream, with respect to paper web travel, of the sensing system 2, for example a tear in a dryer 19 (FIG. 3) as schematically indicated by the break 1' in the web 1.

The light source 12 is linear and located at the side of the web 1 remote from the linear scanning array 5 and parallel thereto. The light source 12 has preferably the same width as the transverse dimension of the linear line scanner 5, so that at least one light guide, located outside of the width of the web, is illuminated if the web is normal, that is, not torn and runs straight. Even a small tear down-stream of scanner 5 may cause lateral skew or deflection of the web.

Supervision of a running web and operation

The width of the web, when operating normally, is projected on the linear line scanner 5, that is, the array of light fibers 4, 1 . . . n. If the web is normal, and in perfect condition, only those light guides 4 which extend over the edges of the paper web will be illuminated. The number of the "dark" or not illuminated light guides 4 provides an indication of the integrity of the paper web. If the paper web, however, has a tear or holes, more light will reach the CCD chip 7, and the evaluation and control circuit 9 will provide a "damage" output signal on line 15. The space between the glass fiber optics 3, that is, the linear line scanning array 5 to the paper web, is so sensed that, with the given spacing d, a line resolution of between 1 to 5 mm of the surface of the web 1 can be obtained.

If the paper web I should break in the dryer 19, as schematically indicated at break 1', the break will immediately be reflected by loss of tension at the printing station itself. The paper will be deflected from its straight paper path and tend to adhere to one of the cylinders 21 or 22 (FIG. 3) due to the adhesive tacky characteristics of printing ink. It can even adhere to both cylinders, in part, due to the now inclined position of the web with respect to the axes of the cylinder shafts. It may even happen that the extended end of the web 1 is pulled back into the printing machine. The combined sensing by the reflected light sensor 11 and the linear array 5 provides for instantaneous recognition of loss of tension, and lateral deflection, for prompt activation of the damage control apparatus 10.

The basic construction and operation of the damage control apparatus, such as a paper capturing device, is well known and any suitable apparatus may be used in the system.

Figure 1A:
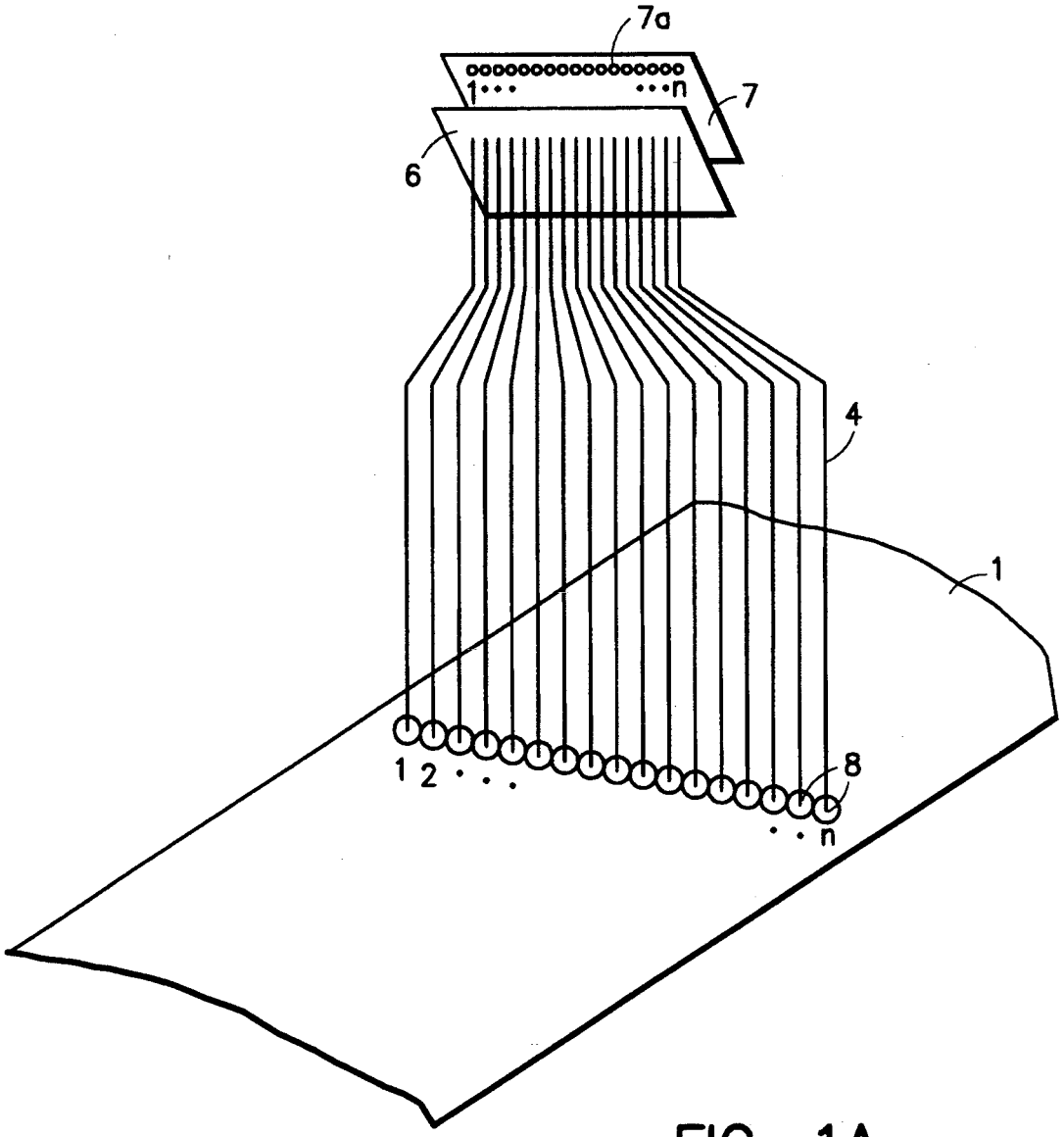
FIG. 1A is a highly schematic fragmentary view of the system of FIG. 1 showing association of light guides to pixels of a charge coupled device (CCD).

The image evaluation and control unit 9 essentially includes an image responsive portion and a microprocessor for processing the image signals received. Upon initial placement of the system into use, it is first calibrated to associate the various positions 8 of all the 1 . . . n light guides 4 to the 1 . . . m pixels 7*a* of the charge coupled device sensor chip 7 (see FIG. 1A). It is, of course, also possible to so arrange the light guides 4 upon bundling and physically compressing the light guides in the bundling and compression element 6 such that the association of the particular light guides 4 with respect to a specific position 8 is predetermined. A specific advantage of the arrangement in accordance with the present invention is that any optics—which are expensive and complex—and resulting calibration within the machine is not necessary, regardless of whether the CCD is associated with specific light guides or specific light guides are associated with specific CCD pixels.

The evaluation and control unit 9, coupled to the sensor chip 7, has outputs 15, for example a plurality of parallel output circuits for direct control of the damage control apparatus, for example the paper capturing unit 10 (FIG. 3); alternatively, it can be coupled to a freely programmable control, or serial outputs for connection to an existing system can be provided, as well known in control unit construction.

Figure 2A:
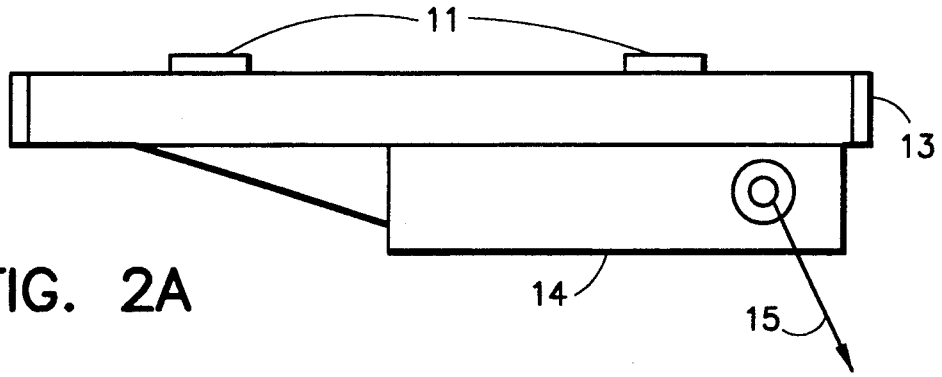
FIG. 2A is a top view illustrating the mechanical construction of the light guide arrangement.
Figure 2B:
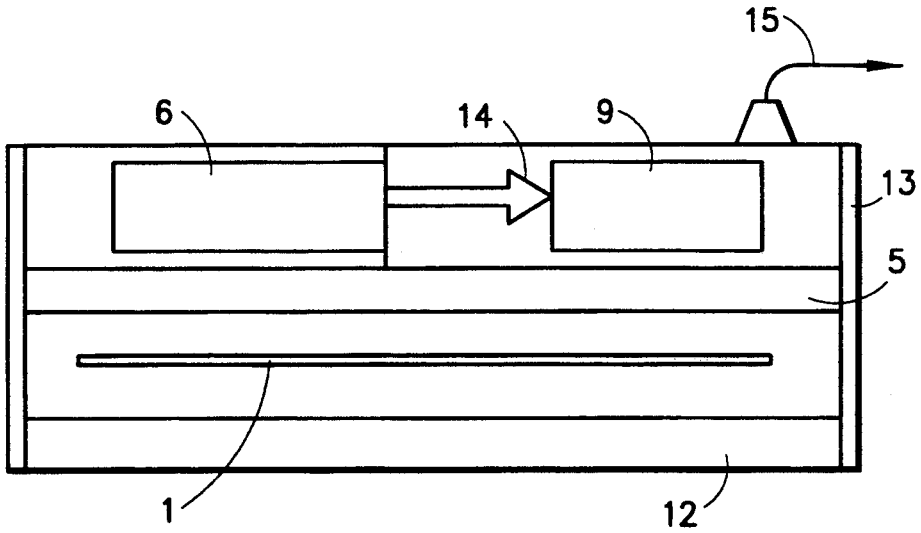
FIG. 2B is a side view of the structure of FIG. 2A.

The physical arrangement of the apparatus in accordance with the present invention is best seen in FIGS. 2A and 2B. A frame 13 retains the light source 12, as well as the linear light guide array 5 and, additionally, the bundling and light guide compression element 6 as well as a unit 14 which includes the CCD sensor chip 7 and the evaluation and control unit 9. Thus, a compact structure is provided which can be placed at a suitable position within the printing machine, for example by a hook-in arrangement in such a position that the paper web 1 can be passed between the light source 12 and the light guide array 5, as shown, for example, in FIG. 2B. Reflex light sensors 11 can be secured to or integrated on the frame 13 (FIG. 2A). Connection to an external utilization apparatus, such as the damage control apparatus 10, is obtained by the external bus or connection line 15. Since there is no optical system which must be calibrated or adjusted, it is thus possible in the simplest way to remove or flip off the frame 13 and thus the complete unit 5, 6 and 11–15 for servicing, cleaning or the like, or completely remove it, for example, for replacement. The connection 15 can be severable, for example a suitable plug-in connector can be used.

The overall protective system for a printing machine is shown in FIG. 3. A printing station 18 has two printing cylinders 21, 22 between which the web 1 is passed. The web then passes between the unit 23, which, schematically, illustrates for example the entire structure shown in FIGS. 1 or 2B, to be then guided to a paper capturing unit 10. The web then passes through a dryer 19 and a cooling unit 20. The system 23 is located as close as possible, with minimum spacing, behind the cylinders 21, 22—in the direction of running of the web—so that the paper path of the web 1 can be monitored. The unit 23 can be secured, for example, between the side walls of the printing station 18, for example by a latchable bolt and eye-hole hook-in arrangement.

Various changes and modifications may be made within the scope of the inventive concept.

A suitable dimension D to obtain resolution of damaged areas on the web 1 of from 1 to 5 mm is: X max. 20 mm particularly when the spacing d between light guide positions 8 is: X 5 mm

I claim:

1. In combination with a printing machine system (18, 21, 22, 19, 20), having a damaged web damage control unit (10), apparatus (2, 23) for optical supervision of the web (1) running through the printing machine system, and for generating a defect signal upon sensing a deviation of the web from a normal condition, said apparatus comprising an elongated light source (12) positioned transversely to the longitudinal extent of the web (1) at one side thereof, and being wider than the width of the web to be supervised;

an optical scanner (3) including a plurality of fiber optic light guides (4) positioned at the other side of the web, whereby the web will pass between said light source and said scanner, said plurality of light guides being located in a line across the web and positioned to receive light from the elongated light source to form a linear line scanner (5), said linear line scanner being wider than the width of the web to be supervised;

a charge coupled device (CCD) sensor chip (7) having individual pixels directly coupled to the light guides (4) and receiving optical signals directly from said light guides, said charge coupled device sensor chip (7) transducing said optical signals into electrical signals from each of the light guides;

a light guide bundling element (6) for bundling the light guides (4) together to have a linear extent substantially smaller than the width of the web, and unambiguously associating each of the light guides (4) and hence the light from any one of the light guides with a specific pixel of the charge coupled device sensor chip (7), wherein at least one light guide is positioned on both sides of the web to be supervised beyond the width of the web, and said elongated light source (12) extends to a region beyond the sides of the web to illuminate, under normal conditions at all times, the light guides located beyond the sides of the web to be supervised;

a signal evaluation and control unit (9) coupled to the charge coupled device sensor chip (7) and providing defect signals if the signals from the charge coupled device sensor chip (7) deviate from a standard signal representative of normal condition; and coupling means (15) connecting said signal evaluation and control unit (9) to said damage control unit (10).

2. The combination of claim 1, further comprising a plastic block (5*a*) into which said light guides (4) are embedded, said plastic block having a surface face directed towards the elongated light source (12), with the web (1) interposed.

3. The combination of claim 2, wherein the spacing of said optical scanner, including the plurality of light guides from said web is so adjusted that an image resolution of between 1 and 5 mm is obtainable.

4. The combination of claim 3, wherein said printing machine system includes a dryer (19) and the scanner is located upstream, with respect to web travel, of the dryer (19).

5. The combination of claim 3, wherein said printing machine system comprises a printing station having printing cylinders (21, 22), and said apparatus is located closely adjacent said cylinders.

6. The combination of claim 2, wherein the light guides within said linear line scanner (5) form an array with predetermined spacing (d) from each other of between 1 to 5 mm.

7. The combination of claim 6, further including a reflected light sensor (11) integrated with the optical scanner (3) to sense movement of the web transverse to its longitudinal direction.

8. The combination of claim 2, further including a reflected light sensor (11) integrated with the optical scanner (3) to sense movement of the web transverse to its longitudinal direction.

9. The combination of claim 2, wherein said printing machine system includes a dryer (19) and the scanner is located upstream, with respect to web travel, of the dryer (19).

10. The combination of claim 2, wherein said printing machine system comprises a printing station having printing cylinders (21, 22), and said apparatus is located closely adjacent said cylinders.

11. The combination of claim 2, wherein said surface face is polished.

12. The combination of claim 3, further including a reflected light sensor (11) integrated with the optical scanner (3) to sense movement of the web transverse to its longitudinal direction.

13. The combination of claim 1, wherein the spacing of said optical scanner, including the plurality of light guides from said web is so adjusted that an image resolution of between 1 and 5 mm is obtainable.

14. The combination of claim 1, wherein the light guides within said linear line scanner (5) form an array with predetermined spacing (d) from each other of between 1 to 5 mm.

15. The combination of claim 1, wherein said charge coupled device sensor chip (7) comprises a linear charge coupled device element.

16. The combination of claim 1, wherein said charge coupled device sensor chip (7) comprises an area charge coupled device element.

17. The combination of claim 1, further including a reflected light sensor (11) integrated with the optical scanner (3) to sense movement of the web transverse to its longitudinal direction.

18. The combination of claim 1, wherein said web comprises a paper web.

19. The combination of claim 1, wherein said printing machine system includes a dryer (19) and the scanner is located upstream, with respect to web travel, of the dryer (19).

20. The combination of claim 1, wherein said printing machine system comprises a printing station having printing cylinders (21, 22), and said apparatus is located closely adjacent said cylinders.

* * * * *